US008844416B2

(12) United States Patent
Walker et al.

(10) Patent No.: US 8,844,416 B2
(45) Date of Patent: Sep. 30, 2014

(54) LATTICE CUTTING MACHINE

(75) Inventors: David B. Walker, Meridian, ID (US); Allen J. Neel, Nampa, ID (US)

(73) Assignee: J.R. Simplot Company, Boise, ID (US)

( * ) Notice: Subject to any disclaimer, the term of this patent is extended or adjusted under 35 U.S.C. 154(b) by 220 days.

(21) Appl. No.: 13/341,911

(22) Filed: Dec. 31, 2011

(65) Prior Publication Data

US 2012/0167737 A1 Jul. 5, 2012

Related U.S. Application Data

(60) Provisional application No. 61/429,839, filed on Jan. 5, 2011.

(51) Int. Cl.

| | |
|---|---|
| ***B26D 7/06*** | (2006.01) |
| ***B26D 5/08*** | (2006.01) |
| ***B26D 1/29*** | (2006.01) |
| ***B26D 1/60*** | (2006.01) |
| ***B26D 1/56*** | (2006.01) |
| *B26D 1/00* | (2006.01) |

(52) U.S. Cl.

CPC ..... *B26D 1/29* (2013.01); *B26D 7/0675* (2013.01); *B26D 1/60* (2013.01); *B26D 2001/006* (2013.01); *B26D 1/0006* (2013.01); *B26D 1/56* (2013.01); *Y10S 83/932* (2013.01)

USPC ..... 83/402; 83/647.5; 83/932

(58) Field of Classification Search

USPC ..... 83/98, 99, 402, 591, 646, 647.5, 321, 83/327, 337, 592, 643, 599, 734, 373, 83/356.1, 356.3, 355, 51, 42, 36, 35; 99/545, 537

See application file for complete search history.

(56) References Cited

U.S. PATENT DOCUMENTS

| | | | | | |
|---|---|---|---|---|---|
| 773,483 | A | * | 10/1904 | Drew | 241/55 |
| 898,109 | A | * | 9/1908 | Hottman | 83/592 |
| 1,150,969 | A | * | 8/1915 | Rudnicki | 83/591 |
| 2,024,353 | A | * | 12/1935 | Goodman, Jr. | 83/437.7 |
| 2,712,842 | A | * | 7/1955 | Fahrni | 144/162.1 |
| 2,934,117 | A | | 4/1960 | Urschel et al. | |
| 3,139,127 | A | | 6/1964 | Urschel et al. | |

(Continued)

FOREIGN PATENT DOCUMENTS

GB 2078101 A * 1/1982

OTHER PUBLICATIONS

Illustrated sourcebook of mechanical components, Editor: parsley, R.O copyright 2000 McGraw hill p. 23-26.*

*Primary Examiner* — Sean Michalski
*Assistant Examiner* — Jonathan G Riley
(74) *Attorney, Agent, or Firm* — Lowry Blixseth LLP; Stuart O. Lowry; Scott M. Lowry

(57) ABSTRACT

A lattice cutting or slicing machine includes a multi-knife lattice cutting plate mounted in-line along an hydraulic flow path through which vegetable products such as potatoes are propelled in single file by a hydraulic fluid such as water. The lattice cutting plate is orbitally driven for engaging in succession each of the multiple knives thereon with the vegetable product to form lattice cut slices wherein successive generally corrugated cuts are angularly oriented typically perpendicular to each other, and further wherein the depths or troughs of the corrugated cuts on opposite sides of each slice intersect in the preferred form to define a pattern of corrugations interrupted by small openings.

15 Claims, 4 Drawing Sheets

(56) References Cited

U.S. PATENT DOCUMENTS

| | | | | |
|---|---|---|---|---|
| 3,139,130 | A | 6/1964 | Urschel et al. | |
| 4,937,084 | A * | 6/1990 | Julian | 426/144 |
| 5,095,875 | A | 3/1992 | Morris et al. | |
| 6,041,682 | A | 3/2000 | Jensen et al. | |
| 6,044,741 | A | 4/2000 | Sapp et al. | |
| 6,148,702 | A | 11/2000 | Bucks | |
| 6,148,709 | A * | 11/2000 | Bucks | 83/663 |
| 6,928,915 | B2 | 8/2005 | Jensen et al. | |
| 7,137,325 | B2 | 11/2006 | Bajema et al. | |
| 2003/0145698 | A1 * | 8/2003 | Bucks | 83/13 |
| 2009/0202694 | A1 | 8/2009 | Julian et al. | |

* cited by examiner

LATTICE CUTTING MACHINE

BACKGROUND OF THE INVENTION

This invention relates generally to improvements in devices and methods for cutting food products such as vegetable products, such as potatoes, into lattice or waffle-cut slices. More particularly, this invention relates to a relatively simple yet highly effective lattice cutting or slicing machine for cutting a succession of potatoes or the like traveling along a hydraulic flow path into lattice or waffle-cut slices.

Potato slices having a lattice or waffle-cut geometry represent a popular food product. Such potato slices are characterized by corrugated cut patterns on opposite sides of each slice, wherein the opposing cut patterns are angularly oriented relative to each other such as at approximate right angles. The troughs or valleys of the opposing corrugated cut patterns are desirably sufficiently deep to partially intersect one another, resulting in a potato slice having a generally rectangular grid configuration with a repeating pattern of small openings formed therethrough. Relatively thin lattice cut slices of this type are commonly processed to form lattice cut potato chips. Thicker lattice cut slices are typically processed by parfrying and/or finish frying to form lattice or so-called waffle-cut French fries.

Slicing machines have been developed for production cutting of potatoes and other food products into lattice cut slices of the type described above. One such lattice cut slicing machine is shown and described in U.S. Pat. No. 3,139,130, which is incorporated by reference herein. This lattice cut slicing machine comprises an upwardly open housing having a rotary impeller mounted therein for receiving and guiding products such as potatoes into cutting engagement with a plurality of lattice cut slicing knives mounted on a peripheral stationary cutting assembly or frame. More particularly, the products are fed by suitable conveyor or supply means to fall downwardly through an upwardly open inlet throat of the rotary impeller, which in turn throws the products radially outwardly by centrifugal action into a plurality of radially open guide tubes. These guide tubes support and rotate the products as the impeller rotates to carry the products into cutting engagement with non-rotating lattice cut slicing knives mounted on the stationary cutting frame. In addition, these guide tubes rotate the products through approximately 90°, relative to a radial guide tube axis, between engagement with successive slicing knives, so that the cut patterns formed on opposite sides of each slice are oriented approximately perpendicular to each other. In a production environment, such slicing machine is capable of handling a substantial mass through-put of products, and typically operates with an impeller speed on the order of about 400 revolutions per minute (rpm).

For additional examples of lattice cut slicing machines, see U.S. Pat. Nos. 3,139,127 and 6,928,915; U.S. Publication 2009/0202694; and U.S. Prov. Appln. 61/329,843, all of which are incorporated by reference herein.

While rotatably supporting and manipulating the vegetable product such as a potato for sequentially engaging multiple stationary lattice cut slicing knives is effective to produce a substantial quantity of lattice or waffle-cut slices, modern production requirements typically require several such slicing machines to operate in parallel with each other to meet consumer demand. As a result, the capital equipment cost tends to be relatively high, particularly in comparison with straight-cut French fry slices which are typically cut by means of a so-called water knife wherein a grid of knife blades are mounted along a hydraulic flume or flow path through which potatoes are propelled one at a time by a hydraulic fluid such as water.

There exists, therefore, a need for continuing improvements in lattice slicing or cutting equipment used in production, and, more particularly, to a lattice cutting machine adapted to rapidly and consistently cut potatoes and the like propelled along an hydraulic flow path into lattice or waffle-cut slices of selected slice thickness. The present invention fulfills these needs and provides further related advantages.

SUMMARY OF THE INVENTION

In accordance with the invention, an improved cutting or slicing machine is provided for cutting products such as food or vegetable products, particularly such as potatoes, into lattice or waffle-cut slices, wherein the slicing machine includes a multi-knife lattice cutting plate mounted in-line along an hydraulic flow path through which the products are propelled in single file by a hydraulic fluid such as water.

In the preferred form, the lattice cutting plate is orbitally driven so that each potato or the like is engaged in succession with each of the multiple knives thereon to form corrugated, lattice cut slices, wherein successive cuts on opposite sides of each slice are angularly oriented preferably approximately perpendicular to each other, and further wherein the depths or troughs of these successive cuts preferably intersect with each other so that each slice is defined by corrugations in combination with a pattern of small openings.

The cutting machine orients and supports the lattice cutting plate generally across the end of an elongated and typically generally tubular flow path through which the products such as potatoes are propelled one-at-a-time from a supply tank with entraining hydraulic fluid such as water by a suitable pump.

The lattice cutting plate is, in the preferred form, carried at opposite ends by a pair of crank arms that are rotatably driven at a selected speed (typically about 1,000 rpm) by a suitable drive motor. The lattice cutting plate defines a plurality of preferably four equiangularly spaced cutting or slicing knives each having a corrugated leading cutting edge for forming a corrugated or waffle-type cut including a selected peak and trough dimension. Each of the multiple slicing knives is further associated with a lead-in ramp for guiding the product into cutting engagement with said slicing knife, and a downstream-located discharge slot for discharging each cut slice in a downstream direction for further processing.

The specific thickness of each cut slice is controlled by variably controlling the speed of orbital movement of the lattice cutting plate in relation to the speed of travel of each product such as a potato along the flow path, so that each potato is forced by the hydraulic fluid against the ramps and further into cutting engagement with the slicing knives on the lattice cutting plate. In one preferred form, with the lattice cutting plate displaced orbitally by the drive motor at about 1,000 rpm, the products (potatoes) are pumped along the hydraulic flow path at a speed of about 80 feet per minute to achieve an individual peak-to-peak slice thickness of about 0.50 inch. In this embodiment, the troughs of the lattice cuts are formed on opposite sides of each cut slice to slightly intersect to define the pattern of corrugations in combination with the pattern of small openings. To achieve the desired hydraulic force against each potato product, the velocity of the hydraulic fluid will be somewhat greater, and the velocity of each potato product will be somewhat greater until each potato product engages the rotary driven lattice cutting plate.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
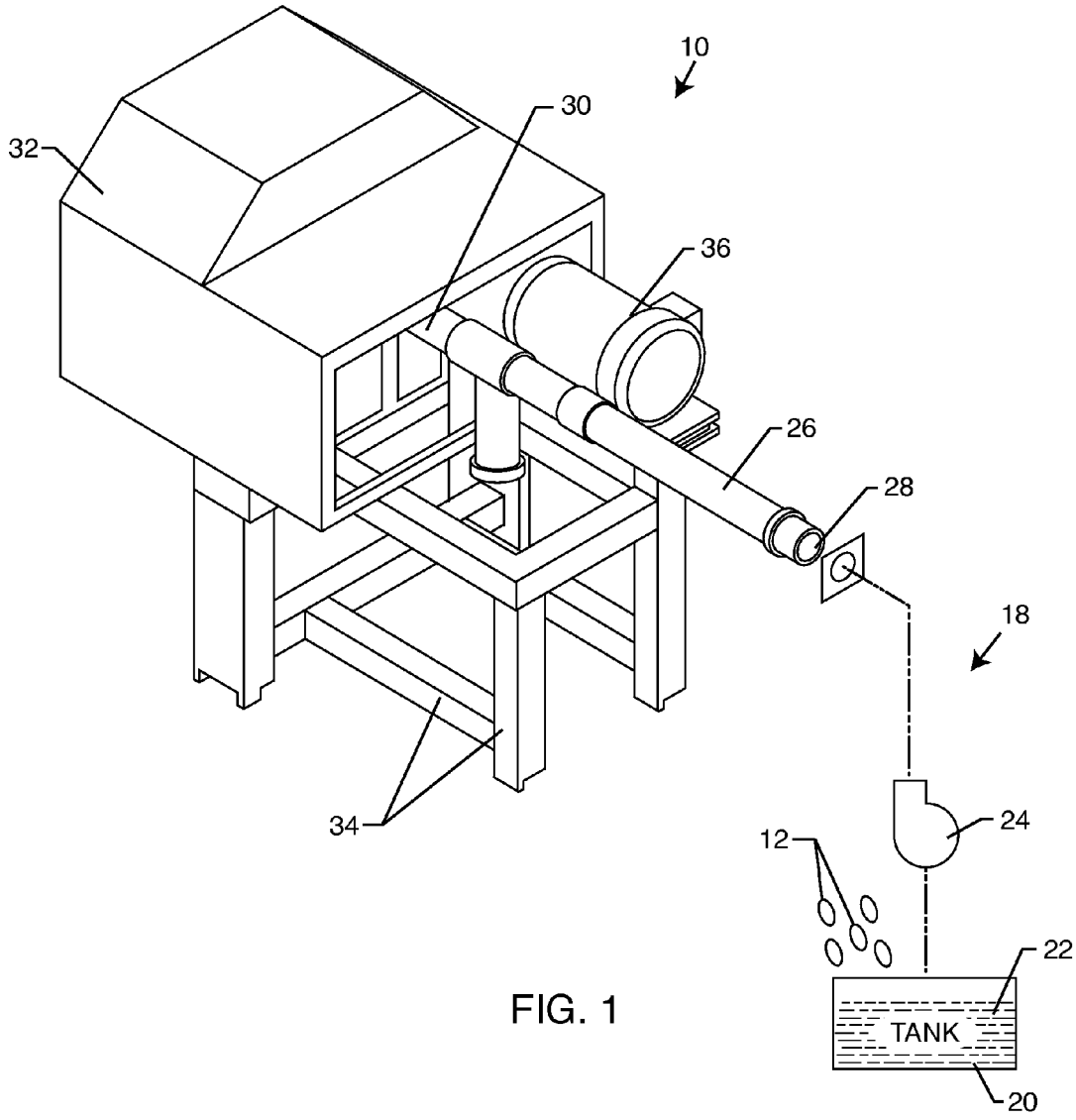
FIG. 1 is a perspective view illustrating a lattice cutting machine constructed according to the novel features of the invention, and shown in association with a pump for propelling food products such as potatoes along a generally tubular flow path.
Figure 2:
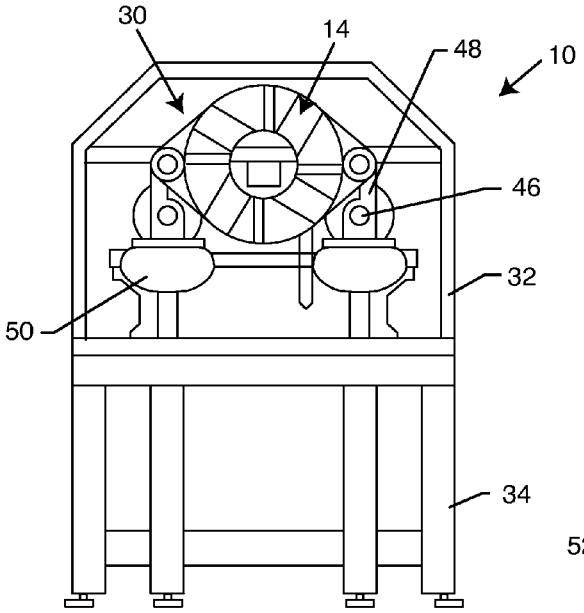
FIG. 2 is a somewhat schematic discharge end elevation view of the lattice cutting machine of FIG. 1, and illustrating internal components thereof.
Figure 3:
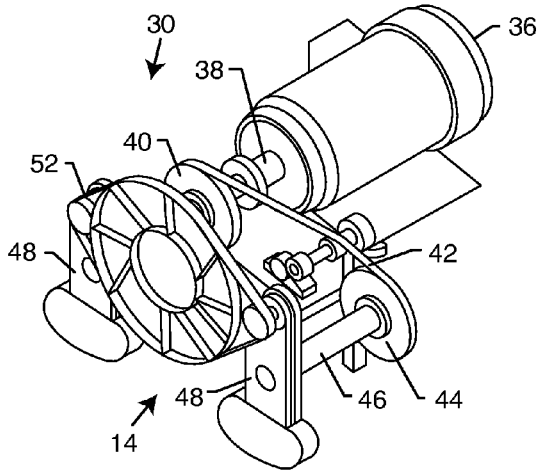
FIG. 3 is an enlarged perspective view showing a drive assembly including a multi-knife lattice cutting plate in association with a drive motor and related orbital drive means.
Figure 4:
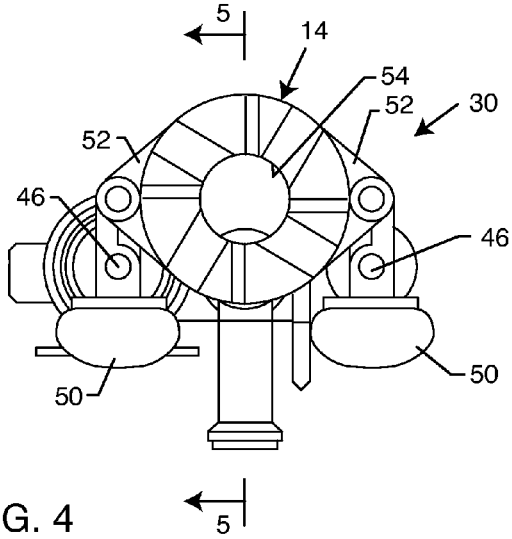
FIG. 4 is a further enlarged end elevation view of the drive assembly of FIG. 3.
Figure 5:
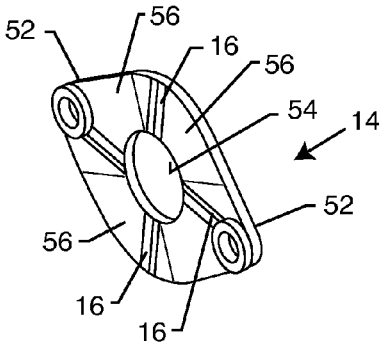
FIG. 5 is a perspective view of the multi-knife lattice cutting plate.
Figure 6:
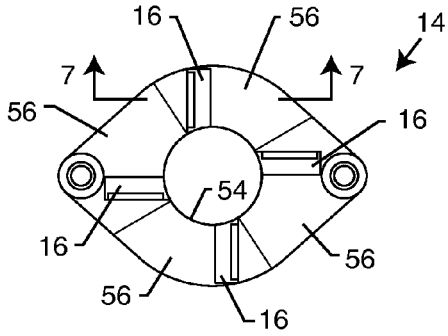
FIG. 6 is an elevation view of the multi-knife lattice cutting plate of FIG. 5.
Figure 7:
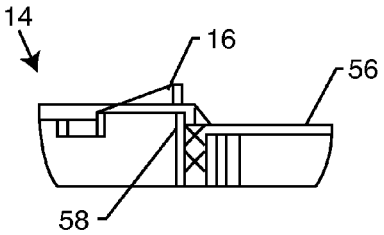
FIG. 7 is an enlarged and fragmented sectional view taken generally on the line 7-7 of FIG. 6.

As shown in the exemplary drawings, a lattice cutting or slicing machine referred to generally in FIGS. 1-2 by the reference numeral 10 is provided for cutting products such as vegetable products, and particularly such as potatoes 12 (FIG. 1), into a plurality of lattice cut or waffle-cut slices of selected thickness. The cutting machine 10 includes an orbitally driven lattice cutting plate 14 (FIGS. 2-4 and 5-8) having multiple corrugated (FIG. 8) cutting or slicing knives 16 for sequentially engaging and cutting each product with a corrugated cut pattern on opposite sides thereof oriented at about right angles to each other. The thickness of each individual cut slice can be controlled so that the troughs associated with these perpendicularly oriented cut opposite sides slightly intersect to form a pattern of small openings in each cut slice.

FIG. 1 shows the lattice cutting machine 10 of the present invention in combination with hydraulic feed means 18, including a supply tank 20 for receiving a quantity of products such as potatoes 12 into an hydraulic fluid such as water 22. As is known in the art, a suitable pump 24 or the like draws the potatoes 12 or the like in single file with the hydraulic fluid 22 and propels the potatoes in single file and substantially without rotation entrained within the fluid 22 at a selected and typically relatively high velocity through an elongated and generally tubular conduit 26 defining a generally tubular flow path 28 leading to a water knife cutting station 30. Such hydraulic feed means 18 are known in the art for use with so-called water knife systems used to rapidly cut products such as potatoes into elongated French fry strips suitable for subsequent production processing steps including blanching, parfrying and freezing before shipment to a customer. See, e.g., U.S. Pat. Nos. 5,042,342; 4,082,024; and 4,423,652.

The tubular conduit 26 generally terminates within the cutting machine 10 at the water knife cutting station 30. As shown in FIG. 1, the cutting machine 10 comprises, in one preferred form, a housing 32 defining a generally enclosed cover supported at a suitable elevated position by a support frame or legs 34. A drive motor 36 (FIGS. 1 and 3) is provided for orbitally or rotatably driving the lattice cutting plate 14 (FIGS. 2-4) at a controlled and preferably variably selected rate of speed. As shown, a rotary output shaft 38 of the drive motor 36 is coupled to an output pulley 40 which is in turn coupled by a suitable drive or cog belt 42 to a driven pulley 44 which is thus rotatably driven by the drive motor 36 at the same speed as the output pulley 40. These two pulleys 40, 44 are coupled in turn to respective associated output shafts 46 for rotatably driving a pair of crank links 48 at the selected rate of speed. As shown, in the preferred form, these crank links 48 are suitably attached to opposite ends, respectively, of the lattice cutting plate 14, and may also include counterweights 50 or the like for smooth rotational operation.

The lattice cutting plate 14 is thus orbitally driven by the drive motor 36 through a generally circular path in the illustrative embodiment, wherein this circular path is disposed generally perpendicular to a centerline of the product flow path 28. As shown, the lattice cutting plate 14 comprises a generally circular component having a pair of opposite-end extensions 52 for facilitated rotatable connection to the ends of the crank links 48. The lattice cutting plate 14 also includes a central aperture 54 formed therein to facilitate movement of the hydraulic fluid such as water 22 through the orbitally driven plate 14. In addition, if desired, the lattice cutting plate 14 may also include a plurality of small apertures (not shown) formed throughout the plate area for additional water relieving flow.

Importantly, the lattice cutting plate 14 also carries the multiple lattice or corrugated cutting knives 16, with four such knives 16 being shown in the exemplary drawings supported on an upstream side of the cutting plate 14 in a generally equiangularly array whereby the knives 16 are oriented generally at intervals of about 90°. Each cutting knife 16 is further associated with an identical recessed ramp 56 (FIGS. 5-7) defined on the upstream side thereof at a leading position relative to the associated knife 16 and the direction of cutting plate rotation. Accordingly, each product in succession is driven by the hydraulic fluid 22 against the ramp 56 which guides the product 12 into cutting engagement with the associated cutting knife 16, with a cut slice traveling through a narrow dimension slot 58 (FIG. 7) in the cutting plate 14 associated with each of the knives 16 to a downstream position for further production processing, such as blanching, parfrying and freezing. In this regard, the specific angle of the ramps 56 together with the narrow dimensions of the associated slots 58 impacts slice thickness.

Figure 8:
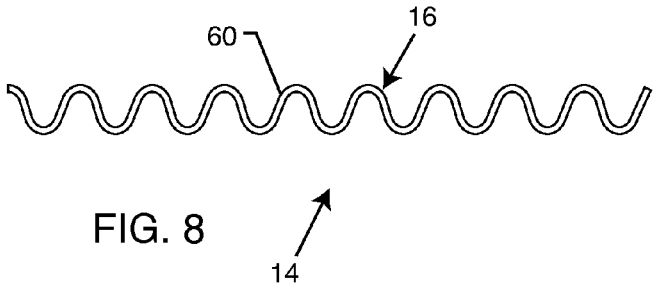
FIG. 8 is an end elevation view of one of the multiple cutting knives mounted on the lattice cutting plate.

FIG. 8 shows one of the cutting knives 16 in end elevation to illustrate a cutting edge 60 thereof of generally corrugated shape. Thus, each cutting knife 16 defines a peak and valley or trough configuration to form a corrugated peak-trough cut in the associated product such as a potato 12. Persons skilled in the art will recognize, in the preferred form, that the multiple cutting knives 16 are identical.

Figure 9:
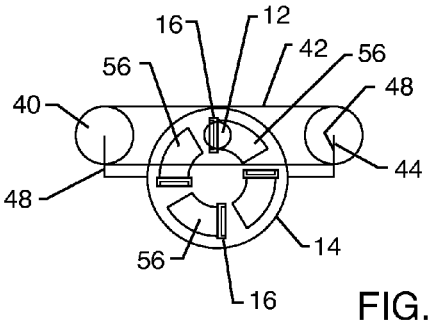
FIG. 9 is a somewhat schematic diagram illustrating the multi-knife lattice cutting plate in a first or initial displacement position relative to a vegetable product such as a potato.

FIGS. 9-16 show one full revolution of the lattice cutting plate 14 relative to an hydraulically driven product such as a potato 12 in 45° increments to cut the product into lattice or waffle-cut slices. As shown, FIG. 9 depicts a first or initial rotational position, with both crank links 48 in a downwardly extending orientation. In this initial position, a product 12 is disposed in cutting engagement with an uppermost one of the cutting knives 16 which forms a corrugated cut pattern on the product, and wherein a cut slice is discharged from the cutting plate 14 in a downstream direction through the slot 58.

Figure 10:
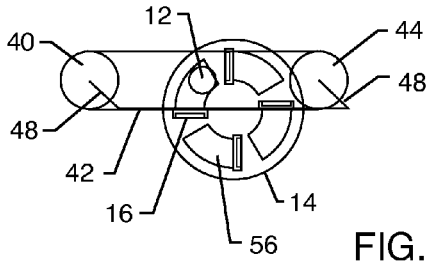
FIG. 10 is a somewhat schematic diagram similar to FIG. 9 but showing the lattice cutting plate in a second displacement position.
Figure 11:
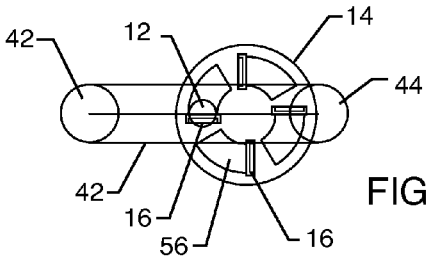

FIG. 10 shows the crank links 48 rotatably advanced in a counterclockwise direction (as viewed) through an angular displacement of about 45°. In this second position, the product 12 at the upstream side of the cutting plate 16 enters the next ramp 56 in succession. FIG. 11 shows the two crank links advanced another approximate 45° to extend toward the right-hand side (as viewed) for cutting engagement with the next knife 16 in succession. Importantly, this forms another corrugated cut pattern in the product 12, but this second cut pattern is oriented approximately at a right angle, or perpendicular to, the cut pattern on the opposite side of the cut slice.

Figure 13:
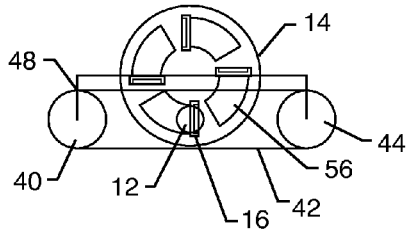
FIGS. 11-16 are also somewhat schematic diagrams similar to FIGS. 9 and 10 but respectively depicting the lattice cutting plate in third, fourth, fifth, sixth, seventh, and eighth displacement positions.
Figure 12:
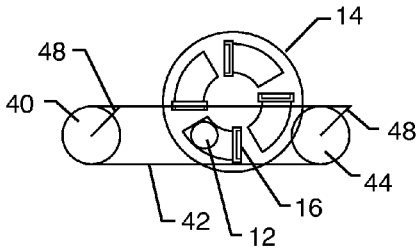

FIGS. 12-13 respectively shown further crank line rotation through increments of about 45°, so that the product 12 engages the next ramp 56 in succession on the upstream side of the cutting plate 14 (FIG. 12), followed in turn by engagement with the next cutting knife 16 in succession (FIG. 13) to form yet another corrugated cut pattern on the product, and to discharge yet another cut slice for further production processing. Again, the corrugated cut patterns on the opposite sides of this discharged cut slice are oriented at about a right angle to each other.

Figure 14:
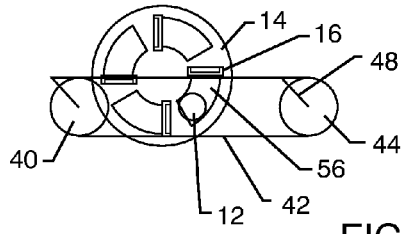
Figure 15:
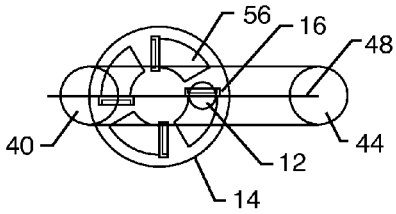
Figure 16:
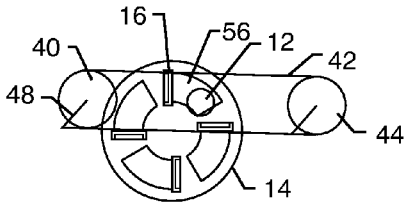

FIGS. 14-15 and FIG. 16 respectively show further crank link rotation through increments of about 45°, for product engagement with the ramps 56 (FIGS. 14 and 16) followed in turn by product cutting engagement with the next cutting knives 16 (FIGS. 15 and 9) in succession on the cutting plate 14. Engagement with each cutting knife 16 thus creates a corrugated cut pattern in the product, while discharging a cut slice through the associated slot 58 (FIG. 7) for further production processing. Importantly, each cut slice has the corrugated cut patterns on opposite sides thereof oriented at about right angles to each other.

By closely controlling the orbital rotational speed of the lattice cutting plate 14 in relation to the speed of travel of each product 12 along the hydraulic flow path 28, the individual thickness of each cut slice can be closely and consistently controlled. In this regard, the hydraulic fluid propelling each product 12 is at a sufficient mass flow rate to force each product against the ramps and into cutting engagement with the slicing knives 16 for a closely controlled slice thickness governed by the ramp geometry. If the lattice cutting plate 14 is orbitally rotated at a speed of about 1,000 rpm, then the illustrative four cutting knives 16 thereof will make 4,000 cuts per minute as the cutting plate 14 is rotatably driven by the drive motor 36. With this parameter, the speed of travel of each product 12 such as a potato is variably adjusted (in the preferred form) to a speed of travel of about 80 feet per minute (fpm) to result in a cut slice thickness having a peak-to-peak dimension of about 0.50 inch. Alternative ramp configurations will, of course, result in alternative slice thicknesses. It is noted, however, that the product 12 such as a potato at all times remains centered generally between the pulleys 40, 44.

With a peak-to-peak cut slice thickness of about 0.50 inch, in the preferred form, each of the cutting knives 16 carried by the lattice cutting plate 14 has a trough or valley or depth dimension at least slightly greater than ½ the slice thickness. With this geometry, when the two corrugated cut patterns are formed on opposite sides of each cut slice, the troughs of the two patterns at least slightly intersect to form a pattern of small openings in each cut slice. In the preferred form, the height dimension of each cutting knife 16 is selected to be about 0.30 inch, to form small openings having a generally rectangular dimension of about 0.20 inch by about 0.20 inch with a peak-to-peak cut slice thickness of about 0.50 inch.

A variety of modifications and improvements in and to the lattice cutting machine 10 of the present invention will be apparent to those persons skilled in the art. As one example, the specific number of slicing knives 16 on the cutting plate 14 can vary, with corresponding change in the product throughput rate. As another example, the thickness of each cut slice can be selected in relation to knife geometry so that the corrugated troughs defined by the slicing knives 16 do not intersect and thus do not form cut slices including a pattern of small holes. Accordingly, no limitation on the invention is intended by way of the foregoing description and accompanying drawings, except as set forth in the appended claims.

What is claimed is:

1. A cutting machine for cutting vegetable products into the form of lattice cut slices, comprising:

a cutting plate having a central aperture formed therein for flow through passage on an hydraulic fluid used to propel the products in single file along a product flow path, said cutting plate further including a plurality of four cutting knives carried thereby and oriented angularly with respect to each other, wherein said four cutting knives are carried by said cutting plate at approximate 90° intervals and oriented substantially perpendicular to each successive cutting knife, each of said cutting knives having a corrugated configuration defining adjacent peaks and troughs, wherein each of said cutting knives has a trough dimension at least slightly greater than ½ the peak-to-peak dimension of each cut slice whereby each cut sliced has a regular pattern of small holes formed therein to define the lattice cut slices; and a water knife cutting station for rotatably driving said cutting plate through an orbital path disposed generally perpendicular to said flow path, whereby said cutting plate is moved through the orbital path relative to said flow path at a speed selected according to the velocity of travel of the product along said flow path for moving said four cutting knives sequentially and repeatedly into cutting engagement with the product to form each product slice having a corrugated, lattice cut shape.

2. The cutting machine of claim 1 wherein the cutting plate further defines a plurality of recessed ramps positioned respectively at the upstream sides of each of said cutting knives for guiding the products into cutting engagement with the cutting knives, and a corresponding plurality of slots formed therein respectively at the downstream side of each of said cutting knives for of each cut slice therethrough for further processing.

3. The cutting machine of claim 1 further including means for propelling the product along said flow path into cutting engagement with said cutting plate at a velocity of about 80 fpm, and said driving means including means for driving said cutting plate through said orbital path at about 1,000 rpm to produce cut slices having a peak-to-peak dimension of about 0.5 inch.

4. The cutting machine of claim 1 wherein said water knife cutting station for rotatably driving said cutting plate comprises a drive motor, and pulley means driven by said drive motor for rotatably driving said cutting plate through said orbital path relative to said product flow path.

5. The cutting machine of claim 4 wherein said pulley means comprises an output pulley driven by said drive motor, a driven pulley, a drive belt reeved about said output and driven pulleys for rotatably driving said driven pulley, and a pair of crank links coupled between said cutting plate and said output and driven pulleys, respectively, for rotatable driving said cutting plate through said orbital path.

6. The cutting machine of claim 4 wherein said product flow path is generally centered between said output and driven pulleys.

7. The cutting machine of claim 1 wherein the vegetable products comprise potatoes.

8. A cutting machine for cutting vegetable products, comprising:

a cutting plate having a central aperture formed therein for flow through passage on an hydraulic fluid used to propel the products in single file along a product flow path, said cutting plate further including a plurality of four cutting knives carried thereby and oriented angularly with respect to each other at approximate 90° intervals and oriented substantially perpendicular to each successive cutting knife, each of said cutting knives having a corrugated configuration defining adjacent peaks and troughs; and a water knife cutting station for driving said cutting plate through an orbital path disposed generally perpendicular to said flow path, whereby said cutting plate is moved through the orbital path relative to said flow path at a speed selected according to the velocity of travel of the product along said flow path for moving said four cutting knives sequentially and repeatedly into cutting engagement with the product to form each product slice having a corrugated cut shape with corrugations on opposite sides thereof formed substantially perpendicularly.

9. The cutting machine of claim 8 wherein the cutting plate further defines a plurality of recessed ramps positioned respectively at the upstream sides of each of said cutting knives for guiding the products into cutting engagement with the cutting knives, and a corresponding plurality of slots formed therein respectively at the downstream side of each of said cutting knives for of each cut slice therethrough for further processing.

10. The cutting machine of claim 8 further including means for propelling the product along said flow path into cutting engagement with said cutting plate at a velocity of about 80 fpm, and said driving means including means for driving said cutting plate through said orbital path at about 1,000 rpm to produce cut slices having a peak-to-peak dimension of about 0.5 inch.

11. The cutting machine of claim 10 wherein each of said cutting knives has a trough dimension at least slightly greater than ½ the peak-to-peak dimension of each cut slice whereby each cut sliced has a regular pattern of small holes formed therein to define lattice cut slices.

12. The cutting machine of claim 8 wherein said water knife cutting station for rotatably driving said cutting plate comprises a drive motor, and pulley means driven by said drive motor for rotatably driving said cutting plate through said orbital path.

13. The cutting machine of claim 12 wherein said pulley means comprises an output pulley driven by said drive motor, a driven pulley, a drive belt reeved about said output and driven pulleys for rotatably driving said driven pulley, and a pair of crank links coupled between said cutting plate and said output and driven pulleys, respectively, for rotatable driving said cutting plate through said orbital path.

14. The cutting machine of claim 13 wherein said product flow path is generally centered between said output and driven pulleys.

15. The cutting machine of claim 8 wherein the vegetable products comprise potatoes.

* * * * *